US006196480B1

(12) United States Patent
Fukuda et al.

(10) Patent No.: US 6,196,480 B1
(45) Date of Patent: Mar. 6, 2001

(54) BALL MILL, A METHOD FOR PREPARING FINE METAL POWDER, AND FINE METAL POWDER PREPARED BY THE METHOD

(75) Inventors: Takeshi Fukuda; Kensuke Hidaka, both of Kyoto; Tamiho Mizutani, Uji; Motonori Nishida, Kyoto; Yoshio Kohira, Uji, all of (JP)

(73) Assignee: Fukuda Metal Foil & Powder Co., Ltd., Kyoto (JP)

( * ) Notice: Subject to any disclaimer, the term of this patent is extended or adjusted under 35 U.S.C. 154(b) by 0 days.

(21) Appl. No.: 09/274,020

(22) Filed: Mar. 22, 1999

(51) Int. Cl.[7] ..... B02C 17/18

(52) U.S. Cl. ..... 241/18; 241/23; 241/57; 241/65

(58) Field of Search ..... 241/57, 65, 23, 241/18, 19, 80, 172, 97

(56) References Cited

U.S. PATENT DOCUMENTS

| | | | | |
|---|---|---|---|---|
| 3,917,175 | | 11/1975 | Maeda et al. . | |
| 4,673,134 | * | 6/1987 | Barthelmess | 241/57 |
| 4,811,909 | * | 3/1989 | Inoki | 241/57 |
| 5,197,680 | * | 3/1993 | Chauveau | 241/57 |
| 5,346,146 | * | 9/1994 | Nitta | 241/57 |

FOREIGN PATENT DOCUMENTS

| | | | | |
|---|---|---|---|---|
| 0549552 | * | 6/1993 | (EP) | 241/172 |
| 10-80643 | | 3/1998 | (JP) . | |

* cited by examiner

*Primary Examiner*—Mark Rosenbaum
(74) *Attorney, Agent, or Firm*—Armstrong, Westerman, Hattori, McLeland & Naughton

(57) ABSTRACT

There is provided a ball mill having a milling chamber into which metal powder is fed. The ball mill is also provided with milling means for milling metal powder into fine metal powder having a particle size less than a predetermined size. When the ball mill operates, a quantity of heat ($Q_0$) is generated in the milling chamber. The milling chamber is cooled by liquid cooling means and gas cooling means according to the present invention. The liquid cooling means causes cooling liquid to flow along the outside wall of the milling chamber to remove a quantity of heat ($Q_1$) during the ball mill operation. The gas cooling means causes cooling gas to flow through the milling chamber to remove a quantity of heat ($Q_2$) during the ball mill operation. The generated quantity of heat ($Q_0$) can be counterbalanced with the sum of the removed quantities of heat ($Q_1$) and ($Q_2$) so as to prevent the inside of the milling chamber from overheating, so that the ball mill can operate in the condition of $Q_0/V \geqq 0.05$ kW/l, where V is the inner volume of the milling chamber.

8 Claims, 1 Drawing Sheet

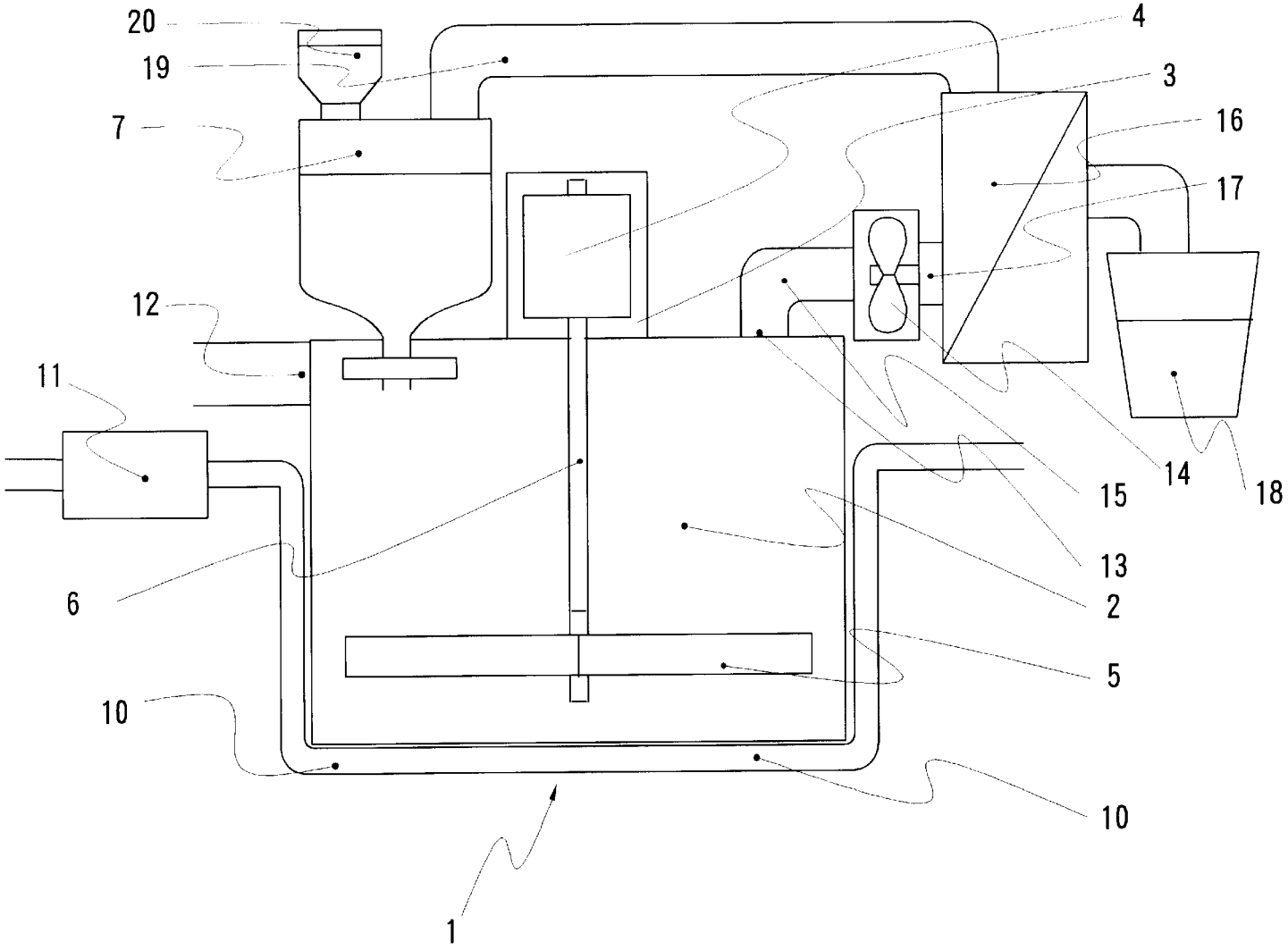
20
19
7
12
11
6
10
1
10
5
2
13
15
14
4
3
16
17
18

BALL MILL, A METHOD FOR PREPARING FINE METAL POWDER, AND FINE METAL POWDER PREPARED BY THE METHOD

BACKGROUND OF THE INVENTION

1. Field of the Invention

The present invention relates to a ball mill for preparing fine metal powder. The present invention also relates to a method for preparing fine metal powder.

2. Prior Art

Various types of ball mills have been proposed to improve the efficiency for preparing fine metal powder per unit time. Theoretically, the more power is supplied to a ball mill in order to prepare fine metal powder, the larger amount of fine metal powder can be produced. However, when power is fed into a milling chamber of the ball mill, only a very small part of the fed power is used for milling metal powder, and the rest is converted into heat in the milling chamber during the ball mill operation, so that the temperature in the milling chamber is elevated. The elevated temperature in the milling chamber causes such a problem that obtained metal powder is oxidized, ignited or aggregated. Therefore, it is required to remove the heat generated in the milling chamber during the ball mill operation.

If all the power consumed by an agitator provided in the ball mill during the ball mill operation is converted into a quantity of heat ($Q_0$), the efficiency of the ball mill operation can be estimated by the energy density $Q_0/V$, where V is the inner volume of the milling chamber. It is demanded that a ball mill is arranged to operate continuously in the condition of a high energy density $Q_0/V$. However, the energy density $Q_0/V$ of a conventional ball mill is calculated at 0.03 kW/l at most. If more power is fed to raise the energy density $Q_0/V$, it will be impossible to keep a heat balance in the milling chamber, and the milling chamber will overheat.

One way to solve the above problem is to seal the milling chamber with non-oxidative gas. This way helps prevent metal powder from oxidizing or igniting, but makes it difficult to efficiently discharge the heat in the milling chamber from the milling chamber because the milling chamber is sealed. However long the milling operation may be continued in this condition, fine metal powder cannot be prepared since milled metal powder is aggregated because of the elevated temperature in the milling chamber and so on.

This way also makes it impossible to extract or take out the milled metal powder until the ball mill operation is finished, resulting in that the obtained milled metal powder has various wide ranges of particle size. There is also existing coarse metal powder which remains not to be sufficiently milled in the milling chamber. Therefore, this way needs to separate the obtained metal powder into fine and coarse metal powders, and is impossible to mill the starting metal powder in the fine metal powder with the yield of 100%.

Japanese Patent Publication No. 33783 of 1978 discloses a ball mill having a milling chamber with a set of milling blades disposed therein. As the milling blades are rotated, it generates a gas stream to efficiently discharge the heat generated in the milling chamber. The gas stream also entrains the milled metal powder out of the milling chamber to a separator. The separator separates the metal powder into fine and coarse metal powders, and then the fine metal powder is extracted and the coarse metal powder is re-fed into the milling chamber. This conventional ball mill is characterized by that the generated heat can be removed by the gas stream caused by the milling blades. However, when a great deal of metal powder is fed into the milling chamber, a resistance occurs to decrease the rotation rate of the milling blades, so that the heat tends to stay in the milling chamber. Therefore, it is necessary that the ball mill operation is interrupted by temporal suspension for cooling the milling chamber. If not, the milling chamber will overheat.

Therefore, it is an object of the invention to provide an improved and unique ball mill to overcome the above problems.

Another object is to improve the efficiency for preparing fine metal powder by efficiently discharging heat generated in the milling chamber during the ball mill operation, so that the ball mill is able to operate without interruption in the condition of high energy density, especially $Q_0/V \geqq 0.05$.

Another object is to provide a ball mill so arranged that milled metal powder can be extracted continuously to prepare fine metal powder having a narrow range of particle size.

SUMMARY OF THE INVENTION

There is provided a ball mill having a milling chamber into which metal powder is fed. The ball mill is also provided with milling means for milling metal powder into fine metal powder having a particle size less than a predetermined size. When the ball mill operates, a quantity of heat ($Q_0$) is generated in the milling chamber. The milling chamber is cooled by liquid cooling means and gas cooling means according to the present invention. The liquid cooling means causes cooling liquid to flow along the outside wall of the milling chamber to remove a quantity of heat ($Q_1$) during the ball mill operation. The gas cooling means causes cooling gas to flow through the milling chamber to remove a quantity of heat ($Q_2$) during the ball mill operation. The generated quantity of heat ($Q_0$) can be counterbalanced with the sum of the removed quantities of heat ($Q_1$) and ($Q_2$) so as to prevent the inside of the milling chamber from overheating, so that the ball mill can operate in the condition of $Q_0/V \geqq 0.05$ kW/l, where V is the inner volume of the milling chamber.

The ball mill may also be provided with; means for continuously feeding metal powder into the milling chamber; separating means connected to the milling chamber for separating the metal powder entrained by the cooling gas flowing out from the milling chamber into fine metal powder having a particle size less than a predetermined size and coarse metal powder having a particle size over the predetermined size; re-feeding means provided between the milling chamber and the separating means for re-feeding the coarse metal powder into the milling chamber for further milling; and outlet means provided in the separating means for continuously extracting the fine metal powder.

These and other aspects of the present invention will become more apparent to those skills in the art with reference to the following description and appended drawing.

BRIEF DESCRIPTION OF THE DRAWING

FIG. 1 is a schematic of the ball mill according to the present invention which can operate continuously in the condition of the high energy density.

DESCRIPTION OF THE PREFERRED EMBODIMENTS

As shown in FIG. 1, a ball mill 1 is provided with a milling chamber 2 having a generally cylindrical shape and an agitator 3. The agitator 3 comprises a motor 4 fixed at the centre of the top wall of the milling chamber 2 and a set of milling blades 5 which are rotated by the motor 4 via a driving shaft 6.

A feeder 7 is provided on the top wall of the milling chamber 2. The feeder 7 continuously feeds metal powder into the milling chamber so as to keep the amount of metal powder in the milling chamber 2 constant. Milling balls are previously put in the milling chamber before the milling operation is started. The milling balls are made of metal having a hardness higher than the metal powder to be milled. When the ball mill 1 operates, heat is generated in the milling chamber.

According to the present invention, the ball mill is provided with liquid cooling means and gas cooling means in order to remove the heat generated in the milling chamber. The liquid cooling means comprises a channel 10 surrounding the side wall and the bottom wall of the milling chamber and a pump 11 for supplying cooling liquid into the channel 10. This channel 10 is preferably made of material having relatively high heat conductivity. The gas cooling means comprises an inlet 12 and an outlet 13 (20 cm in diameter) provided in the milling chamber, and an aspirator or suction pomp 14 connected to the outlet 13 for aspirating or sucking the cooling gas, so that the cooling gas is introduced at the inlet 12 to flow through the milling chamber 2 to be discharged from the outlet 13. The liquid cooling means causes the cooling liquid to chiefly cool the milling chamber along the walls of the milling chamber, while the gas cooling means causes the cooling gas to chiefly cool the core of the milling chamber.

The cooling gas discharged at the outlet 13 also transports or entrains out the milled metal powder 15 into a separator 16. The metal powder entrained out from the milling chamber has a particle size determined by the size of the outlet 13 and the flow rate of the cooling gas to be described hereinafter. The larger the outlet provided in the milling chamber is and the faster the cooling gas is aspirated at the outlet 13, the larger the particle size of the metal powder entrained out from the milling chamber becomes. The cooling gas may also be fed at the inlet 12.

The separator 16 is connected to the outlet 13 through a duct 17, and separates the metal powder entrained out by the cooling gas into fine and coarse metal powders. The separator 16 is of centrifugal type, but other types of separator may also be used. The separator 16 is arranged to separate the metal powder according to a predetermined size. The separated fine metal powder is continuously put in the exit box 18 so as to be extracted or taken out, and the separated coarse metal powder is transported to the feeder 7 through a duct 19 in order to re-feed it into the milling chamber 2 for further milling.

When the ball mill operates with electric power (E) being consumed by the motor 4, heat is generated in the milling chamber as described before. In the present ball mill, it can be assumed that all the electric power (E) is converted into a quantity of heat ($Q_0$) during the ball mill operation. The quantity of heat ($Q_0$) is removed by the cooling liquid and the cooling gas according to the present invention. In detail, a quantity of heat ($Q_1$), that is a part of the quantity of heat ($Q_0$), is removed by the liquid cooling means, and a quantity of heat ($Q_2$), that is the rest of the quantity of heat ($Q_0$), is removed by the gas cooling means. In other words, even if the quantity of heat ($Q_0$) generated in the milling chamber is larger than the quantity of heat ($Q_1$) removed by the liquid cooling means, the ball mill can operate without interruption provided that the quantity of heat ($Q_0$) generated in the milling chamber is counterbalanced with the sum of the quantities of heat ($Q_1+Q_2$) removed by the liquid and gas cooling means, which is different from the conventional ball mill.

Therefore, the ball mill can operate in the condition of higher energy density than the conventional ball mill. Especially, the present ball mill can operate in the condition of $Q_0/V \geqq 0.05$ kW/l, preferably $Q_0/V \geqq 0.07$ kW/l, and more preferably 0.07 kW/l$\leqq Q_0/V \leqq 0.15$ kW/l.

The flow rates of the cooling liquid and the cooling gas can be decided on the kind of the milled metal powder, the condition of the ball mill operation and so on. The flow rate of the cooling liquid per unit inner volume (1 l) of the milling chamber may be within a range of 0.1~10 l/min, preferably 0.2~2 l/min, more preferably 0.3~0.7 l/min. The flow rate of the cooling gas per unit inner volume (1 l) of the milling chamber may also be within a range of 1~1000 l/min, preferably 10~500 l/min, more preferably 50~300 l/min. The above preferred ranges of flow rates can be used in any milling chambers, but can especially be applied in the milling chamber having a inner volume of 100~2000 l, preferably 200~1000 l, more preferably 300~700 l.

It is preferable that the cooling gas discharged from the outlet 13 has a temperature less than 100° C., preferably less than 90° C., and more preferably less than 70° C.

For example, the above described ball mill is used in the following way for preparing fine brass powder.

1800 kg of steel balls of 6.5 mm in diameter is put in the milling chamber 2. A mixture of 100 kg of starting brass powder of about 500 $\mu$m in diameter and assistant milling material corresponding to 0.1 weight percentage (1 kg) of the brass powder is provided in the milling chamber 2. The assistant milling material includes lubricants. The separator 16 is set up so that fine metal powder having a particle size less than 40 $\mu$M is obtained in the exit box 18. Cooling water at 20° C. is caused to flow along the channel 10 at a flow rate of 260 l/min, and inert gas at 20° C. is aspirated at the gas outlet 13 to cause the cooling gas to flow through the milling chamber 2 at a flow rate of 50 $m^3$/min. The cooling gas at temperature of about 60° C. is discharged from the gas outlet 13. This cooling gas discharged from the gas outlet 13 entrains out metal powder into the separator 7. The separator 7 separates the entrained metal powder into fine and coarse metal powder.

The fine brass powder is continuously produced in the exit box 18 at a rate of 20 Kg/h during the ball mill operation. The fine brass powder according to the present invention has smooth surface and shows no oxidation nor aggregation and has a very narrow range of the particle size.

The coarse metal powder is transported to the feeder 7, and mixed with another starting brass powder from sub-feeder 20, in the amount corresponding to the fine metal powder put in the exit box 18, and another assistant milling material, in the amount corresponding to 0.1 weight percentage of said another starting brass powder, to be re-fed into the milling chamber 2 for further milling.

The milling chamber (V) has an inner volume of 500 liters, and the motor 3 consumes electric power (E) of 45 KW (38700 kcal/h), and the ball mill can operate without interruption. Since it can be assumed that all the electric power is converted into a quantity of heat ($Q_0$) during the ball mill operation, the energy density of the ball mill is calculated at 0.09 KW/l. The ball mill operation is much more efficient than the conventional ball mill.

Effect of the Invention

The ball mill according to the present invention has higher energy density than the prior ball mill and enables to continuously extract metal powder milled into a predetermined size to thereby produce fine metal powder with a yield of 100% to the starting metal powder.

What is claimed is:

1. A ball mill comprising:

a) a milling chamber into which metal powder is fed;

b) milling means for milling metal powder into fine metal powder having a particle size less than a predetermined size, with a quantity of heat ($Q_0$) generated in the milling chamber during the ball mill operation;

c) liquid cooling means for causing cooling liquid to flow along the outside wall of the milling chamber to remove a quantity of heat ($Q_1$) during the ball mill operation; and d) gas cooling means for causing cooling gas to flow through the milling chamber to remove a quantity of heat ($Q_2$) during the ball mill operation, wherein the liquid cooling means and the gas cooling means cooperate to counterbalance the generated quantity of heat ($Q_0$) with the sum of the removed quantities of heat ($Q_1$) and ($Q_2$) so as to prevent the inside of the milling chamber from overheating, when the ball mill operates in the condition of $Q_0/V \geqq 0.05$ kW/l, at a predetermined temperature of 100° C. and less, where V is the inner volume of the milling chamber.

2. A ball mill of claim 1, further comprising:

f) means for continuously feeding metal powder into the milling chamber;

g) separating means connected to the milling chamber for separating the metal powder entrained by the cooling gas flowing out from the milling chamber, the separating means separating metal powder into fine metal powder and coarse metal powder having a particle size over the predetermined size;

h) re-feeding means provided between the milling chamber and the separating means for re-feeding coarse metal powder into the milling chamber for further milling; and i) outlet means provided in the separating means for continuously extracting fine metal powder.

3. A ball mill of claim 1, wherein the cooling liquid is introduced into the cooling channel surrounding the outside wall of the milling chamber at a flow rate of from 0.3 to 0.7 l/min per unit inner volume (1 l) of the milling chamber.

4. A ball mill of claim 3, wherein the cooling gas is introduced into the milling chamber at a flow rate of from 50 to 300 l/min per unit inner volume (1 l) of the milling chamber.

5. A method for preparing fine metal powder by using a ball mill with a milling chamber, comprising the steps of a) feeding metal powder into the milling chamber;

b) milling metal powder into fine metal powder having a particle size less than a predetermined size, with a quantity of heat ($Q_0$) generated in the milling chamber during the milling step;

c) causing cooling liquid to flow along the outside wall of the milling chamber to remove a quantity of heat ($Q_1$) during the milling step;

d) causing cooling gas to flow through the milling chamber to remove a quantity of heat ($Q_2$) during the milling step, e) counterbalancing the generated quantity of heat ($Q_0$) with the sum of the removed quantities of heat ($Q_1$) and ($Q_2$) so as to prevent the inside of the milling chamber from overheating, when the milling step is carried out in the condition of $Q_0/V \geqq 0.05$ kW/l at a predetermined temperature of 100° C. and less, where V is the inner volume of the milling chamber.

6. A method of claim 5, further comprising the steps of f) providing means for continuously feeding metal powder into the milling chamber;

g) separating metal powder entrained out from the milling chamber by cooling gas into fine metal powder and coarse metal powder having a particle size over the predetermined size;

h) re-feeding coarse metal powder into the milling chamber for further milling; and i) extracting fine metal powder continuously.

7. A method of claim 5, wherein the cooling liquid is introduced into the cooling channel surrounding the outside wall of the milling chamber at a flow rate of from 0.3 to 0.7 l/min per unit inner volume (1 l) of the milling chamber.

8. A method of claim 7, wherein the cooling gas is introduced into the milling chamber at a flow rate of from 50 to 300 l/min per unit inner volume (1 l) of the milling chamber.

* * * * *